US007581555B2

(12) United States Patent
McCullough

(10) Patent No.: US 7,581,555 B2
(45) Date of Patent: Sep. 1, 2009

(54) UMBRELLA SLICKER

(76) Inventor: Deborah D. McCullough, 423 Summit St., Rock Hill, SC (US) 29730

( * ) Notice: Subject to any disclaimer, the term of this patent is extended or adjusted under 35 U.S.C. 154(b) by 0 days.

(21) Appl. No.: 11/970,194

(22) Filed: Jan. 7, 2008

(65) Prior Publication Data

US 2008/0163909 A1 Jul. 10, 2008

Related U.S. Application Data

(60) Provisional application No. 60/878,815, filed on Jan. 5, 2007.

(51) Int. Cl.
*A45B 25/18* (2006.01)
*A45B 15/00* (2006.01)

(52) U.S. Cl. ..... 135/33.2; 135/16; 135/98

(58) Field of Classification Search ..... 135/33.2, 135/33.4, 33.41, 16, 25.41, 34.2, 98; D3/5–10
See application file for complete search history.

(56) References Cited

U.S. PATENT DOCUMENTS

| | | | | | |
|---|---|---|---|---|---|
| 734,311 | A | * | 7/1903 | Ferroussat | 135/16 |
| 1,774,909 | A | * | 9/1930 | Wells | 135/98 |
| 1,854,671 | A | * | 4/1932 | Roberts | 24/537 |
| 2,681,070 | A | * | 6/1954 | Ippolito | 135/16 |
| 3,151,621 | A | * | 10/1964 | Jackson | 135/16 |
| D284,618 | S | * | 7/1986 | St. John | D3/5 |
| 5,025,819 | A | * | 6/1991 | Taylor | 135/16 |
| 5,441,064 | A | * | 8/1995 | Becker et al. | 135/16 |
| 5,582,115 | A | * | 12/1996 | Muller | 108/90 |

FOREIGN PATENT DOCUMENTS

| | | | |
|---|---|---|---|
| GB | 2038620 | A | * 7/1980 |
| GB | 2222942 | A | * 3/1990 |
| JP | 06253916 | A | * 9/1994 |
| JP | 11032820 | A | * 2/1999 |
| JP | 2003033211 | A | * 2/2003 |
| JP | 2004135985 | A | * 5/2004 |
| WO | WO 8707482 | A1 | * 12/1987 |

* cited by examiner

*Primary Examiner*—Winnie Yip
(74) *Attorney, Agent, or Firm*—Michael L. Greenberg, Esq.; Greenberg & Lieberman, LLC

(57) ABSTRACT

A personal rain protection device that enhances traditional umbrella qualities through the use of an unobtrusive slicker that can be deployed to protect a wearer's entire backside from getting wet. The slicker is securely stowed in a holding pocket located within the umbrella canopy. Upon deployment of the slicker, the slicker solidly covers the backside of a wearer. Light weights contained within the fabric of the slicker help stabilize the slicker and prevent it from flailing. In this manner, a wearer may tread through driving rain with added protection and also sit comfortably on a wet bench, bleacher or chair where a deployed slicker will protect his or her backside from the moisture.

18 Claims, 6 Drawing Sheets

UMBRELLA SLICKER

This is a non-provisional application claiming priority to provisional application No. 60/878,815 filed on Jan. 5, 2007.

FIELD OF THE INVENTION

The present invention is a personal rain protection device having a collapsible umbrella and a connecting, foldable slicker capable of hanging from the users shoulders down to the legs to protect the user from the elements. The slicker includes light weights to prevent the present invention from succumbing to wind gusts in addition to compatibility for easy storage. The slicker protects the back of the user to protect him or her from wetness when sitting on a wet bench or seat.

BACKGROUND OF THE INVENTION

People cannot always escape from the rain. Whether it is light rain or a gusty rainstorm where it appears that the rain is driving sideways, there are always people who are caught in the middle. These can be business people who are dressed in expensive and delicate clothes. Others include sports fans that often are seen sitting through rain during outside contests. In addition, parents may be slowed down while accompanying small children. And of course average people also find themselves caught in the rain. But when standing under an awning or dashing into shelter may not be an option, the most common device for rain protection is the umbrella.

Umbrellas typically release a canopy over a wearer's head to prevent rain from getting them wet. However, umbrellas only protect so much, especially when gusty winds are involved. When wind gusts increase, it is not uncommon for umbrellas to fail as they are blown around. Strong wind gusts also have been known to blow umbrellas away and out of the hands of the user. Even beyond those facts is the issue of protecting more parts of the user's clothing when wind gusts cause the rain to blow in at more linear angles instead of direct from above. For these reasons, there remains a need for an umbrella that is more manageable for a user in virtually all wind and rain conditions while still performing the ultimate and inherent function of an umbrella in regard to rain protection.

Beyond the umbrella, raincoats and varying forms of ponchos also are available to those interested in rain protection. However, businesspersons among other people often may not wish to lug a special water resistant coat with them as they walk outside. For example, a warm day with merely cloudy skies may not warrant a raincoat. Moreover, a person also may not wish to mess up his or her hair through the use of a raincoat and attached hood in case it did rain. And the idea of carrying a raincoat and umbrella may be considered bulky and a bit extreme for many people. The same issue revolves around ponchos and other like products. Because of this, there is a need for a device that serves as an umbrella while also maintains additional rain protection, especially for the back of a person.

Protection for the back of a wearer—from the shoulders to the legs—is especially important because during and after it rains, people often may need to sit down on a wet bench, bleacher or other seat. In this way, a back protection element to an umbrella further solves the need for a more encompassing rain protection device. However, the needs for such a device as is the present invention also must conform to the realities of society. This means that there is a need for such an encompassing rain protection device that can be easily stored and compacted to limit the bulkiness and load. Raincoats and ponchos certainly can be folded up, as can umbrellas, but to date there is nothing like the present invention that further minimizes the amount of storage and space often required by people out on the street. Thus, there is a need for a combination umbrella and slicker such as the present invention that can be properly stored in a briefcase or handbag.

U.S. Pat. No. 5,823,212 issued to Allen on Oct. 20, 1998, is a stadium umbrella that uses a clear material as a dome that covers the head on down to a person's torso. Unlike the present invention, Allen caters specifically to those sitting at a sporting event and wishing to protect their head and torso from falling rain. Allen also differs from the present invention because Allen does not account for the fact that those sitting on wet bleachers or wet chairs will still get water on their backsides from the seat area and also if they lean back. The present invention, in contrast, provides canopy protection while also deploys a slicker specifically for the backside so that the user does not have to sit in water.

U.S. Pat. No. 5,664,595 issued to Vonderhorst et al on Sep. 9, 1997, is a screen apparatus positioned atop an umbrella to protect the user specifically from flying insects. Unlike the present invention, Vonderhorst is not primarily concerned with rain as it instead employs insect netting that is detachable and wraps around the umbrella element. The present invention, in contrast, uses a holding pocket and flap to effectively store the rain-protecting slicker.

U.S. Pat. No. 4,838,290 issued to Wu on Jun. 13, 1989, is an umbrella with an extendible brim portion that ultimately connects a stretcher link to the umbrella portion in order to provide a horizontal shielding element that does not interfere with the users line of sight. Unlike the present invention, Wu does not combine storage elements such as the holding pocket and flap as does the present invention. Moreover, the present invention provides wide protection from rain and water in regard to the back of a user who is walking or sitting in a wet seat while the umbrella by Wu does not offer such considerations.

U.S. Pat. No. 4,022,233 issued to Grundman on May 10, 1977, is described as a Venetian umbrella because it essentially attaches a weighted drape that hangs down from the umbrella canopy to encircle the user. Unlike the present invention, Grundman encircles the user with these drapes causing the user to potentially feel claustrophobic and impeded as he or she attempts to fight through a rainstorm while navigating through drapery. In addition, Grundman does not employ material capable of properly protecting the back of the user from wetness specifically when that person attempts to sit on a wet bench or seat. Moreover, the present invention substantially differs from Grundman in that the present invention provides proper storage of the slicker through the use of the holding pocket, flap and connection whereas Grundman does not take into more account the storage of its drape element.

U.S. Pat. No. 2004/0020522 A1 filed by James and published on Feb. 5, 2004, is an umbrella with a detachable drape. James employs a detachable drape that can be attached to the umbrella canopy for use as a sunshade. Unlike the present invention, James merely took a drape and attached it to an umbrella via standard clips. James did not account for a combination element where the two items can be stored together, nor does James serve to protect a user from rain and water while sitting on a wet bench or seat.

Nothing out there has ever combined the function of an umbrella with a slicker to protect a user's back from driving rain and for those common instances of sitting on a wet bench or seat. There is a need for a personal rain protection device like the present invention that combines—in a compact and hassle-free manner—many of the qualities associated with raincoats with a sturdy and more wind-resistant umbrella. Moreover, the need requires that this device be easy to handle and mobile to satisfy the needs of a modern society on the go. The present invention solves all of these needs as it is a unique and compact device for protecting people who are both walking and sitting in the rain from wetness.

SUMMARY OF THE PRESENT INVENTION

The present invention is a personal rain protection device that serves as an umbrella combined and connected with a slicker. The umbrella and slicker combination can function in all types of rainstorms. The slicker aspect is located at the back of a wearer and extends from the users shoulders to the legs. The slicker element also includes relatively light weights at the tail end of the slicker to protect against succumbing to powerful wind gusts. The present invention, including the slicker, is not worn, but rather held by the user through the use of the umbrella handle.

Both elements of the present invention can vary in size and color. The umbrella and slicker elements also can easily be stored and minimized in size to fit into a briefcase or handbag. The umbrella is collapsible and can be folded and stored through the use of a connection device such as, but not limited to, a snap or VELCRO™. The slicker may be tucked away along the bottom side of the umbrella in a flap or pocket that also may be closed and secured by a connection device such as snaps, zipper or VELCRO™.

The umbrella portion of the present invention is actuated through the use of a button that releases the canopy when the button is utilized. The umbrella portion of the present invention includes a holding pocket at its bottom end. The slicker can be rolled or otherwise smashed into the holding pocket. The holding pocket may be located on the outside or inside of the umbrella canopy, although in the preferred embodiment of the present invention, the holding pocket is located on the inside of the umbrella canopy.

To remove the slicker from the holding pocket, the wearer will release the connection device. Once the holding pocket is opened by releasing this connection device, the user will then remove the slicker. The slicker will unravel and will reach a width of about 30½" and a length of about 56" in the preferred embodiment of the present invention. Other dimensions also may be used to cater to people of different sizes, ages, etc. However, the slicker is preferred to be wide enough to extend the width of a user's shoulders and to reach in length from the shoulders to the calf of the users legs.

The slicker contains light weights that are woven into the tail end of its fabric. The light weights keep the tail end weighted down in order to prevent strong wind gusts from blowing the slicker upward or from twisting the slicker inside out. In this manner, the back of the user remains protected from the rain regardless of most powerful wind gusts. In addition, the slicker is vented in order to resist inversion in windy and rainy conditions. In the preferred embodiment of the present invention, the slicker may be polytetrafluoroethylene (PTFE) coated in addition to comprised of a nylon material that will repel rain while subsequently keeping the backside of the user completely dry. Other rain resistant materials also may be used. Also, the slicker's flexible qualities make it ideal for sitting on when a user wishes to keep his or her back dry when sitting on a wet bench or other seat.

An additional embodiment of the present invention employs a band that effectively serves as a belt. The band functions as an additional securing measure so that the slicker is held stationary and close proximity to the wearer's body. In this embodiment, it is envisioned that one end of the band is connected via conventional means to a waist-high portion of a deployed slicker. The free end of the band would connect via conventional means to the opposite side of the slicker to form the belt-like quality.

BRIEF DESCRIPTION OF THE PREFERRED EMBODIMENT

DETAILED DESCRIPTION OF THE PREFERRED EMBODIMENT

Figure 1:
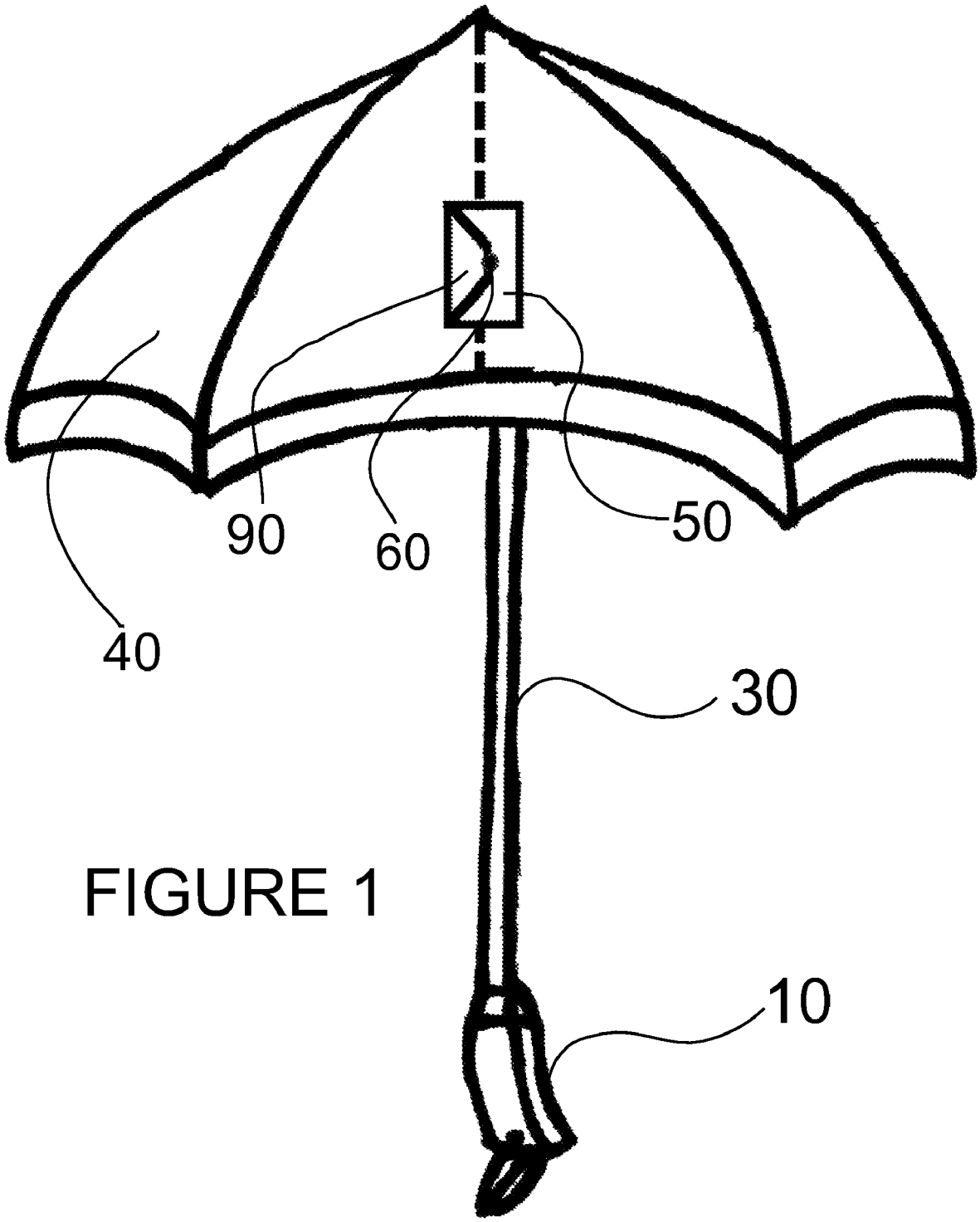
FIG. 1 is a rear view of the present invention while the slicker (70) is not deployed.

FIG. 1 shows us a rear view of the present invention when only the umbrella canopy (40) is deployed. In this view, we see how the present invention can operate with just the umbrella canopy (40) deployed while keeping the slicker (70) rolled, mashed or otherwise stored in its holding pocket (50). Opting to use the umbrella canopy (40) and not the slicker (70) can occur in situations where there is light rain but no significant risk of rain causing wetness to the back of the user.

In FIG. 1, we see that the present invention has a handle (10) where the user can hold the present invention. The handle also contains a button (20) that is better view in FIG. 3. When the button (20) is pushed, the umbrella canopy (40) is activated, as conventional umbrellas are activated via conventional means, from a condensed position to the more traditional umbrella canopy (40) as seen in FIG. 1. Also like a traditional umbrella, the pole (30) between the handle (10) and the umbrella canopy (40) helps maintain stability of the present invention while also providing a conduit to shorten and ultimately store the present invention.

FIG. 1 also shows us how the holding pocket (50) can be seen at the bottom end of the umbrella canopy (40). In the preferred embodiment as seen in FIG. 1, the holding pocket (50) may be about 3" deep and 9" wide. These dimensions permit proper rolling of the slicker (70) to be stored in the holding pocket (50). However, these dimensions may be different because sizes of the overall present invention can differ to cater to users of all sizes and ages. Holding pocket (50) can be placed horizontally, vertically, or at any angle in relation to the bottom of umbrella canopy (40).

Figure 2:
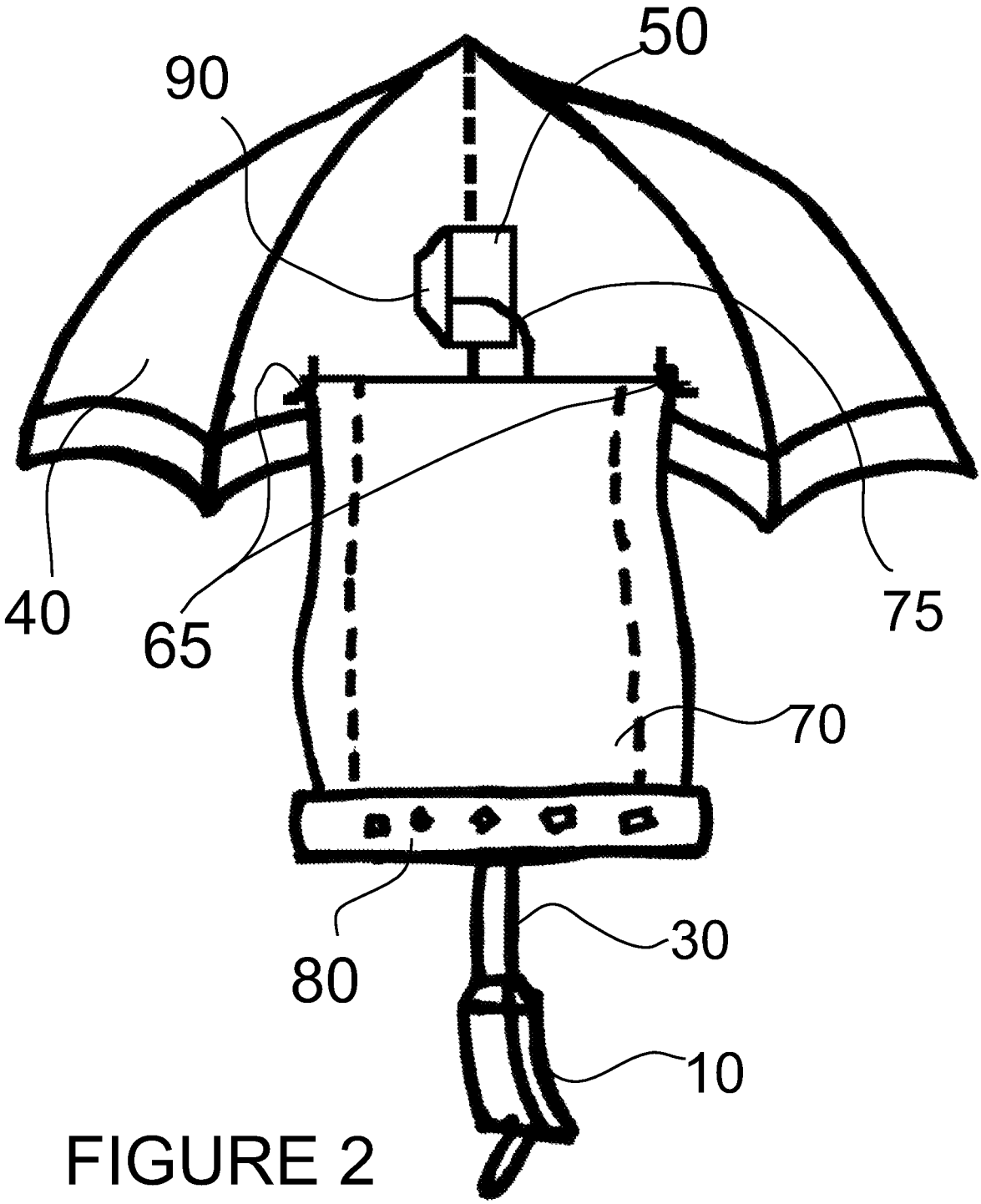
FIG. 2 is a rear view of the present invention while the slicker (70) is deployed.

While the holding pocket (50) can be seen woven into the fabric of the umbrella canopy (40) in the rear view of the present invention as seen in FIG. 1, we also see a flap (90). The flap (90) also is woven into the rear of the umbrella canopy (40). The flap (90) serves as the opening where the user can get at the slicker (70), as the slicker (70) is contained in the holding pocket (50). In the view in FIG. 1, we see that the flap (90) is secured and closed by a connector (60). While the connector (60) in FIG. 1 is a snap, the connector (60) of the present invention also may be any other connection device such as a zipper as seen in FIG. 2 or VELCRO™. The preferred embodiment of the present invention places the holding pocket (50) and its flap (90) on the inside of the umbrella canopy (40). However, it is envisioned that the holding pocket (50) also may be located on the outside of the umbrella canopy (40) in some alternative embodiments.

When the user decides to deploy the slicker (70), he or she simply opens the flap (90). In FIG. 2, we see a view where the user has opened the connector (60), which is demonstrated as a zipper in the embodiment of FIG. 2. Once the flap (90) is opened, the slicker (70) can be removed from the holding pocket (50). The slicker (70) then extends from a point at the holding pocket (50) where the slicker (70) is woven in just inside the flap (90). The bottom of the slicker (70) then extends downward where light weights (80) are woven into the slicker (70) material at its lower areas. The light weights (80) provide just enough weight at the lowest points of the slicker (70) to prevent the slicker (70) from being blown upward or being turned inside out by strong gusts of wind. In this manner, the back of the user remains protected from the rain regardless of most powerful wind gusts. The preferred embodiment of the present invention, as we see in FIG. 2, employs clips (65) that connect the slicker (70) to opposite sides of the umbrella canopy (40) in order to stabilize the width of the slicker (70). The clips (65) are conventional in nature in terms of their connection ability. As seen in FIG. 2, a leash (75) is attached to the slicker (70) and the inside of the holding pocket (50). The leash (75) functions to maintain a woven connection between the holding pocket (50) and slicker (70) so that the slicker remains directly attached to the overall umbrella portion of the present invention. Additional embodiments of the present invention are envisioned without the clips (65). Any conventional method of attachment can replace clips (65).

The slicker (70) itself may be about 30½" wide and about 56" in length. These dimensions can vary depending on the size and age of the user. However, the preferred embodiment of the present invention is to have a deployed slicker (70) extend in width to protect a user's back in width from shoulder to shoulder. In addition, the length should extend from the opening of the flap (90)—which would be about shoulder level when the present invention is in use—down to the calf of the legs of the user. This length is best viewed in the front view of a fully deployed present invention as seen in FIG. 3.

Figure 3:
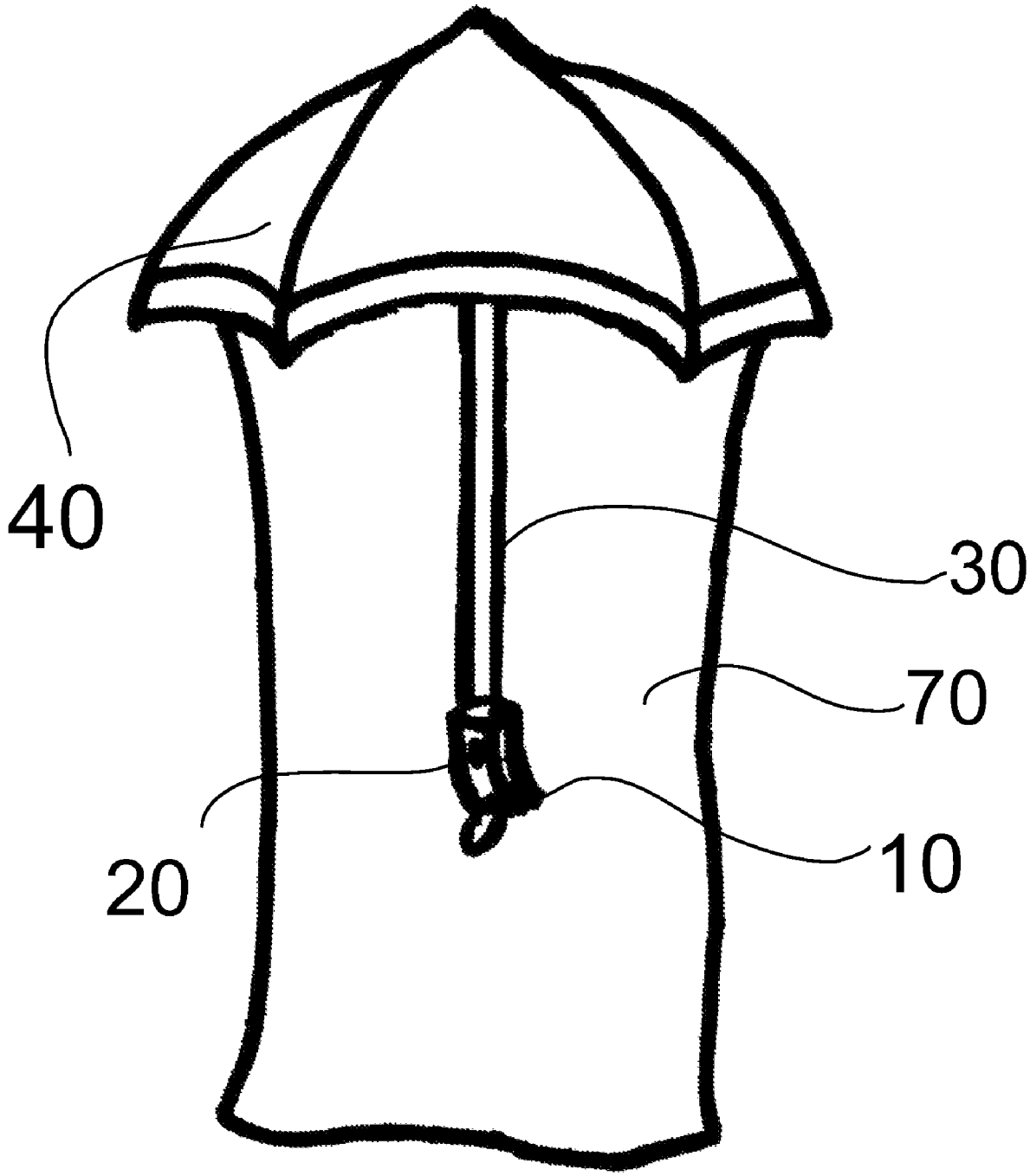
FIG. 3 is a front view of the present invention while the slicker (70) is deployed.

The view of FIG. 3 highlights how the slicker (70) is attached to the back of the present invention and therefore provides personal rain protection for the backside of the user. This protection of the back of the user is important in a number of instances. These include driving rain conditions. In addition, another common situation is when a sports fan attends a contest such as baseball, football, golf or soccer where he or she must sit on a wet chair or bleacher during rainy conditions. In these situations, the slicker (70) provides optimal protection to the back of the user from outside moisture.

In the preferred embodiment of the present invention, the slicker may be polytetrafluoroethylene (PTFE) coated in addition to comprised of a nylon material that will repel rain while subsequently keeping the backside of the user completely dry. Other rain resistant materials also may be used. Also, the slicker's flexible qualities make it ideal for sitting on when a user wishes to keep his or her back dry when sitting on a wet bench or other seat. In addition, the slicker is vented in order to resist inversion in windy and rainy conditions. It is contemplated any venting can be accomplished conventionally with any number of slots, holes, etc. in any pattern—but at the same time too many vents cannot exist else the user will get wet as a lot of rain might pass through the slicker (70).

In FIG. 3, we also see the button (20) that is in connection with the handle (10). As used conventionally in many types of standard umbrellas, the button (20) is a releasing mechanism that unlocks internal elements located inside the pole (30) to ultimately deploy the umbrella canopy (40).

In FIG. 3, we do not see the holding pocket (50) at the far end of the bottom of the umbrella canopy (40). The holding pocket (50) in FIG. 3 is not visible because it is obstructed from view by umbrella canopy (40). The holding pocket (50) remains empty because the slicker (70) had been removed from the flap as seen in FIG. 1 and FIG. 2 as the slicker (70) is deployed downward to protect the backside of the user.

Figure 4:
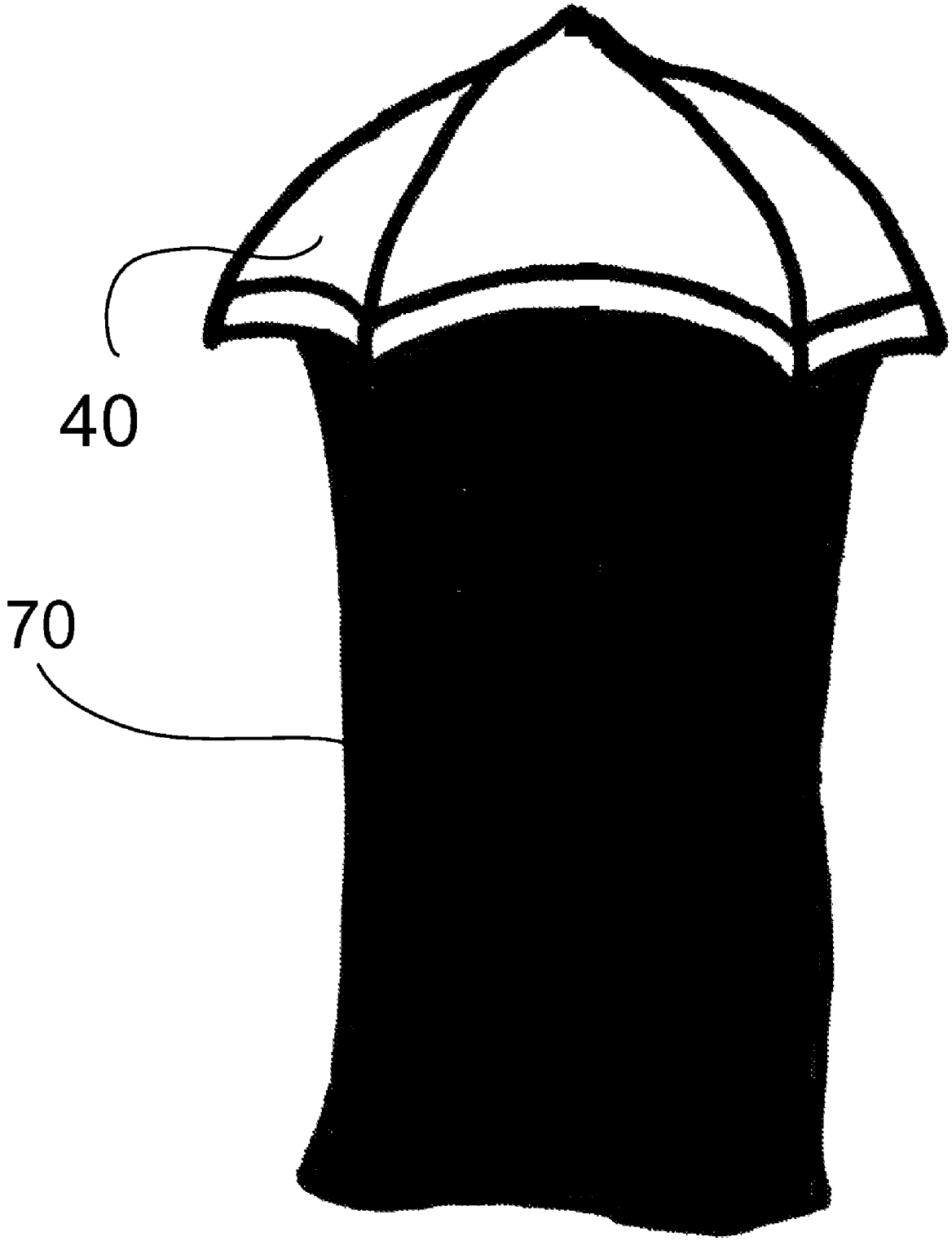
FIG. 4 is a rear view of an aesthetic embodiment of the present invention.

In FIG. 4, we see another rear view of the present invention. FIG. 4 shows us an additional embodiment of the present invention in that it demonstrates how the slicker (70) can be made to be both functionally useful and aesthetically pleasing. In the embodiment of FIG. 4, we see how the slicker (70) material is crafted to round out to better protect the user's shoulder area as the slicker (70) better conforms to the contours of a person's body. In other words, the slicker (70), rather than simply being a sheet of material that is rectangular, is preferably a somewhat rectangular sheet of material that flairs out to become wider toward its top and bottom. In short, the slicker (70) becomes wider as it approaches its corners. ++++FIG. 4 is merely one embodiment of how the present invention can combine a semblance of style to its primary function of rain protection.

Figure 5:
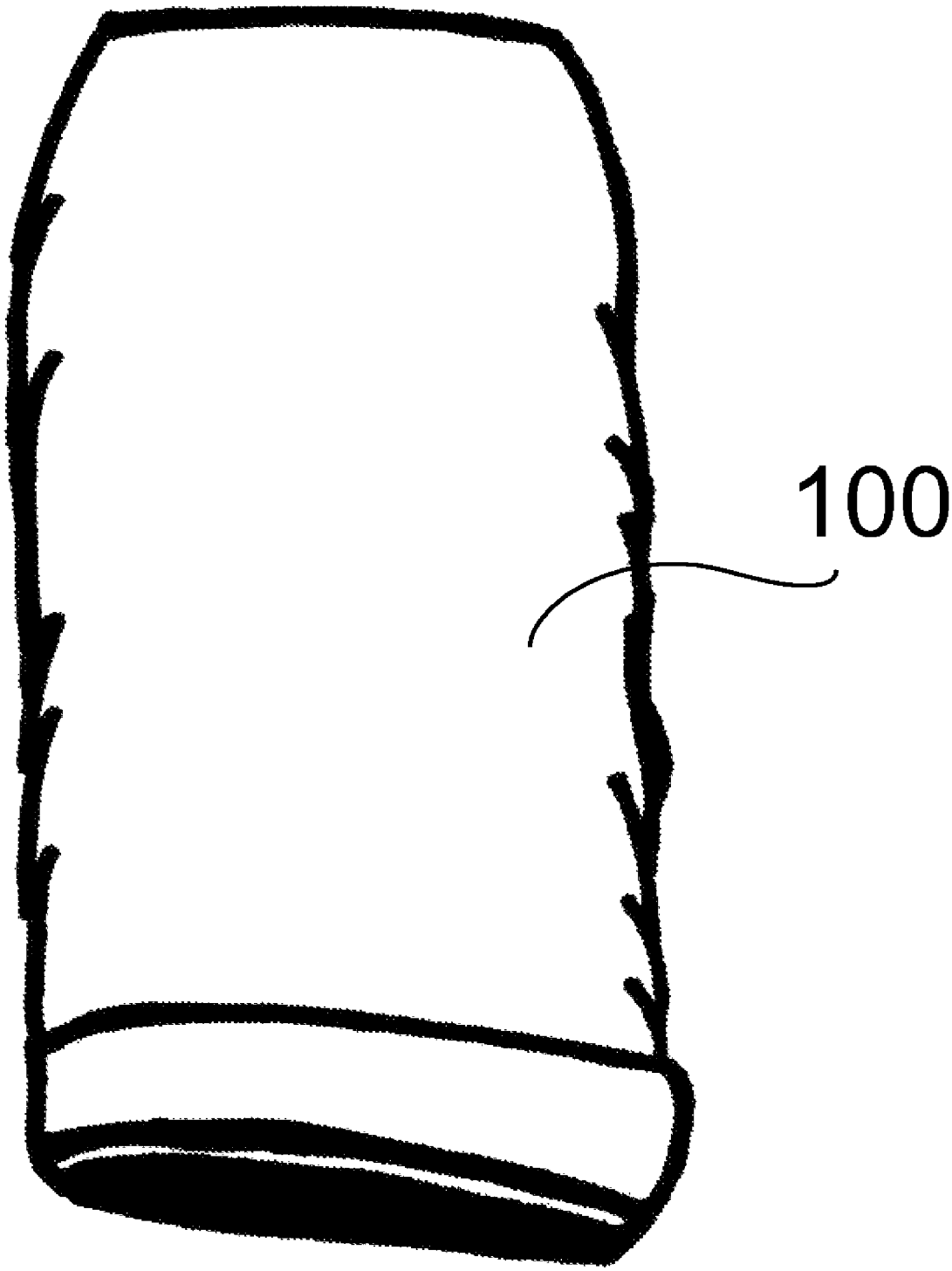
FIG. 5 is a view of the present invention when being stored.

In FIG. 5, we see a view of the present invention while it is being stored and thus minimized in size. The preferred embodiment of the present invention, when in a storing position as seen in FIG. 5, can easily fit into most briefcases or handbags. To place the present invention into its storing position, the user can first press the button (20). The button (20), along with other manual means, is conventional in nature as it collapses the umbrella canopy (40) as a traditional umbrella would. Also, the slicker (70) can be rolled up or otherwise compressed and placed completely into the holding pocket (50). The connection (60) can then be used as the flap (90) is ultimately closed. With the collapsed umbrella canopy (40) and secured flap (90), a manual usage or press of the button (20) will conventionally retract the pole (30) until the entire apparatus retracts back down to the handle (10). A cover (100) such as that seen in FIG. 5 can then be placed over the present invention for proper and minimalized storage.

Figure 6:
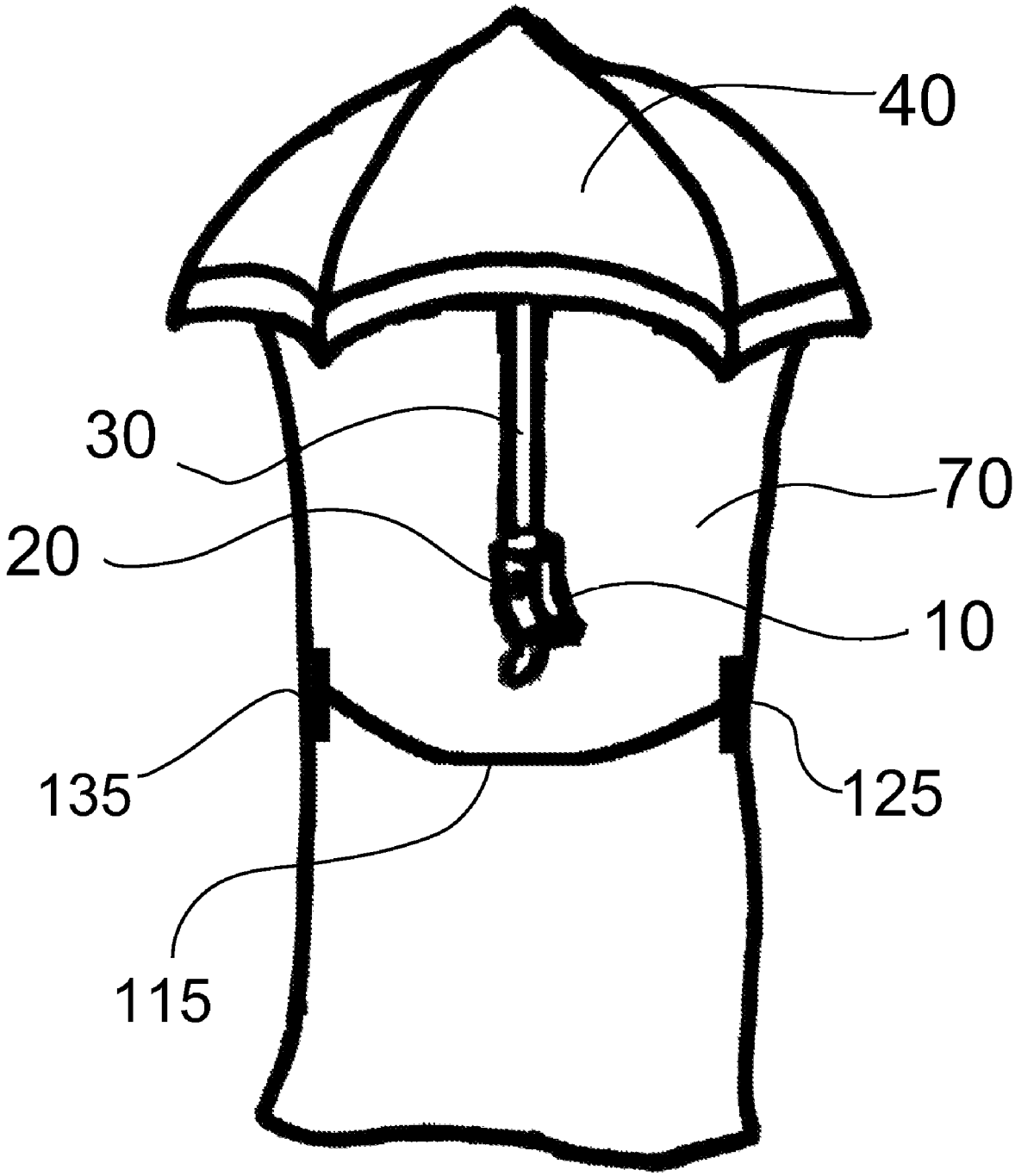
FIG. 6 is an alternative embodiment of the present invention.

FIG. 6 is an alternative embodiment of the present invention. In the view of FIG. 6, we see that the present invention employs a band (115) that effectively serves as a belt. The band (115) functions as an additional securing measure so that the slicker (70) is held stationary and close proximity to the wearer's body. In this embodiment, it is envisioned that a secured band end (125) is connected via conventional means to a waist-high portion of a deployed slicker (70). The free band end (135) would connect via conventional means to the opposite side of the slicker (70) to form the belt-like quality. Additional embodiments relating to the band (115) include additional material for conventional tying at the waist, or conventional belt loop and hook qualities.

Having illustrated the present invention, it should be understood that various adjustments and versions might be implemented without venturing away from the essence of the present invention. The present invention is not limited to the embodiments described above, and should be interpreted as any and all embodiments within the scope of the following claims.

I claim:

1. A rain protection device, comprising:

an umbrella canopy;

a holding pocket disposed on said umbrella canopy;

a slicker, in communication with said holding pocket;

said holding pocket being attached to said umbrella canopy; an internal side of said holding pocket and said slicker, when housed in said holding pocket, are accessible via a flap by a connector, said flap being in communication with said umbrella canopy;

said slicker being attached and extending downward from said umbrella canopy when the slicker is not housed in said holding pocket; and a leash, attached to said slicker and said internal side of said holding pocket.

2. The device of claim 1, wherein said umbrella canopy is configured to retract.

3. The device of claim 1, wherein said umbrella canopy is in communication with a pole.

4. The device of claim 3, wherein said pole is configured to extend down to a handle.

5. The device of claim 4, wherein said handle has a button to deploy and retract said pole and said umbrella canopy.

6. The device of claim 5, wherein said umbrella canopy is in communication with said pole that extends down to said handle which includes a button to deploy and retract said pole and said canopy so that said umbrella canopy, said slicker, said holding pocket, and said pole can be consolidated next to said handle.

7. The device of claim 6, wherein said umbrella canopy is in communication with said pole that extends down to said handle which includes a button to deploy and retract said pole and said canopy so that said umbrella canopy, said slicker, said holding pocket, and said pole can be consolidated next to said handle where it can fit inside of a briefcase or handbag.

8. The device of claim 7, wherein said umbrella canopy is in communication with said pole that extends down to said handle which includes a button to deploy and retract said pole and said canopy so that said umbrella canopy, said slicker, said holding pocket, and said pole can be consolidated next to said handle where it can fit inside of a briefcase or handbag with a cover to encompass all.

9. The device of claim 1, wherein said slicker is removably attached said umbrella canopy.

10. The device of claim 9, wherein said slicker is attached to rear of said umbrella canopy inside said holding pocket.

11. The device of claim 1, wherein said slicker is constructed of a foldable material that is water resistant.

12. The device of claim 1, wherein said slicker extends from rear of said umbrella canopy capably down to the calf area of a person.

13. The device of claim 12, wherein said slicker extends from rear of said umbrella canopy capably down to the calf area of a person and said slicker also can be rolled or fitted completely inside said holding pocket.

14. The device of claim 13, wherein said slicker extends from rear of said umbrella canopy capably down to the calf area of a person and said slicker also can be rolled or fitted completely inside said holding pocket where said holding pocket can be closed via said flap and said connector in communication with said umbrella canopy.

15. The device of claim 1, wherein said holding pocket houses said slicker when said slicker is not extended out from rear of said umbrella canopy.

16. The device of claim 1, wherein said umbrella canopy is constructed of water resistant material.

17. A rain protection device, comprising:

an umbrella canopy;

a holding pocket disposed on said umbrella canopy;

a slicker, in communication with said holding pocket;

said holding pocket being attached to said umbrella canopy; an internal side of said holding pocket and said slicker, when housed in said holding pocket, are accessible via a flap by a connector, said flap being in communication with said umbrella canopy; said slicker being attached and extending downward from said umbrella canopy when the slicker is not housed in said holding pocket;

a leash, attached to said slicker and said internal side of said holding pocket; and clips that connect said slicker to opposite sides of said umbrella canopy.

18. A rain protection device, comprising:

an umbrella canopy;

a holding pocket disposed on said umbrella canopy;

a slicker, in communication with said holding pocket;

said holding pocket being attached to said umbrella canopy; an internal side of said holding pocket and said slicker, when housed in said holding pocket, are accessible via a flap by a connector, said flap being in communication with said umbrella canopy; said slicker being attached and extending downward from said umbrella canopy when the slicker is not housed in said holding pocket;

a leash, attached to said slicker and said internal side of said holding pocket; and light weights are woven into said slicker at lower areas of said slicker.

* * * * *